US005443249A

United States Patent [19]

Rizzolo et al.

[11] Patent Number: 5,443,249

[45] Date of Patent: Aug. 22, 1995

[54] IN-BIN STAPLING SYSTEM WITH INTERACTIVE REGISTRATION WALL

[75] Inventors: Charles D. Rizzolo; Charles E. Prevost, both of Rochester, N.Y.

[73] Assignee: Xerox Corporation, Stamford, Conn.

[21] Appl. No.: 198,713

[22] Filed: Feb. 18, 1994

Related U.S. Application Data

[63] Continuation-in-part of Ser. No. 7,948, Jan. 25, 1993, abandoned.

[51] Int. Cl.[6] ..... B31B 1/68; B42C 1/12

[52] U.S. Cl. ..... 270/53

[58] Field of Search ..... 270/53; 355/324

[56] References Cited

U.S. PATENT DOCUMENTS

| | | | |
|---|---|---|---|
| 4,903,952 | 2/1990 | Russel et al. | 270/53 |
| 4,988,085 | 1/1991 | Maekawa et al. | 270/53 |
| 5,005,751 | 4/1991 | Radtke et al. | 270/53 X |
| 5,098,074 | 3/1992 | Mandel et al. . | |
| 5,201,517 | 4/1993 | Stemmle . | |
| 5,217,215 | 6/1993 | Ohata et al. . | |

FOREIGN PATENT DOCUMENTS

| | | | |
|---|---|---|---|
| 0127976 | 5/1988 | Japan | 270/53 |

OTHER PUBLICATIONS

Xerox Disclosure Journal vol. 4, No. 1, Jan./Feb. 1979, p. 59 "Staple Head Positioning System" Authors: Feil & Tesch.

*Primary Examiner*—John E. Ryznic

[57] ABSTRACT

A system for stacking, registering and fastening printed sheets fed from a reproduction apparatus onto a compiler or other stacking tray, with a plural component vertically extending but laterally movable sheet stacking edge registration system adjacent at least one edge of the stacking tray and a set stapling system movable parallel to the edge registration position to fasten the stack of sheets edge registered in the tray in plural different fastening positions; the edge registration system being movable to provide continuous stapling access therethrough by the set fastening system. The edge registration system is automatically movable in coordination with the stapling system to stay out of its path yet maintain registration of the stack of sheets in the tray at the same edge registration position. The system allows a stapler head with stapling jaws continuously extending into the stacking area to move in a simple linear path parallel to but inside of the edge registration area without obstruction and without requiring complex mechanisms for movements of the copy set, the stapler, or the tray for stapling.

10 Claims, 6 Drawing Sheets

IN-BIN STAPLING SYSTEM WITH INTERACTIVE REGISTRATION WALL

This is a continuation in part of commonly assigned pending U.S. application No. 08/007,948 filed Jan. 25, 1993, now abandoned by the same Charles D. Rizzolo, and others, being refilled as a file wrapper continuation App. No. 08/197,664 on Feb. 17, 1994, now U.S. Pat. No. 5,398,918, issued Mar. 21, 1995.

Cross-reference and incorporation by reference where appropriate is also made to the following other copending applications of the same assignee: App. No. 08/129,489 filed Sep. 30, 1993 and entitled "Low Cost Automatic Unloading Sorter/Finisher" by Barry P. Mandel and William R. Burger, now abandoned and App. No. 08/113,004 filed Aug. 30, 1993 and entitled "High Capacity Sheet Stacking System With Variable Height Input and Stacking Registration" by Denis Stemmle, now U.S. Pat. No. 5,346,203, issued Sep. 13, 1994.

The present invention relates to an improved stacking/finishing apparatus for a printing (reproduction) apparatus, and more particularly an improved stacking/finishing apparatus that incorporates a stapler or other finisher capable of stapling a stack of sheets while the stack is edge registered in a tray or bin thereof in an improved manner without interference between finishing and registering.

Being able to move a single stapler head linearly along one edge of a stack of sheets being collated to desired positions, in order to insert a plurality of staples along that edge of the stack with one stapler, is known to be desirable. An example is shown in the Xerox Disclosure Journal Publication Vol. 4, No. 1, January/February 1979, p. 59; as well as some of the patents cited herein. Also noted thereon, and also disclosing a desirable application or embodiment for the present invention, is the above-cited pending allowed U.S. application No. 08/007,948 filed Jan. 25, 1993 by the same Charles D. Rizzolo, and others. Said application is thus of particular relevance to this application and is incorporated by reference herein.

The disclosed system provides improved output stacking and finishing of multiple printed sheets, such as multiple sets or jobs of flimsy copy sheets sequentially outputted by a copier or printer, with simplified stack alignment and finishing at relatively low cost, and without sacrificing any desired inclined stacking or registration orientations.

The disclosed system does not require complex mechanisms to move a stapling head or the like in and out of a tray or bin for each stapling of a stack of sheets therein, or complex mechanisms for gripping and moving the stack out of and back into the bin for stapling outside the bin.

There is disclosed in the embodiments herein a system allowing the non-interfering lateral movement of a stapler or the like parallel to a stack registration edge while maintaining stack registration. This is particularly useful for plural position stack edge stapling with a single stapler, and/or different set stapling locations for different sheet sizes. The stack registration edge system for the stack sheets in these examples is in plural movable sections so that the stapling head can cause part (only a portion) of the stack registration edge to move out of the way of the stapling head so that the stapling head can extend past the stack registration edge system into the tray and onto or around the stack edge, to staple the stack in the bin at that particular lateral movement position, but to not move all of the stack registration edge system out of the path of the stack, so that the stack continues to be registered or retained by those parts of the stack registration edge system which are not moved out of the way at that time. With this system a simple linear path can be used for the fastener head.

The above-cited copending applications include other cited art in this general technology area. E.g., recent art on different sorter/stapler systems with different moving gates or registration walls includes U.S. Pat. No. 5,217,215 by Y. Ohata, et al, issued Jun. 8, 1993.

By way of further background of some art on in-bin or post-collated job set stapling in sorters, there is noted, e.g., Xerox Corporation U.S. Pat. Nos. 3,884,408 to L. Leiter et al.; 3,944,207 to Bains; 3,995,748 to Looney; 4,687,191 to Stemmle; 4,681,310 to Cooper; and 4,925,171 to Kramer, et al.. Also, Xerox Corporation U.K. 2 173 483-A GB published 15 Oct. 1986 by Denis Stemmle; and U.S. Pat. No. 4,687,191 issued Aug. 18, 1987. Also noted is U.S. Pat. No. 4,083,550 issued Apr. 11, 1978 to R. Pal. Other Xerox Corporation patents include Snellman et al U.S. Pat. No. 4,145,241 and Hamlin et al U.S. Pat. No. 4,564,185 on edge jogging and glue binding sets in a sorter or collator and/or stapling of the post-collated copy sets. Withdrawal of the sets from the respective bins with a gripper extractor and for on-line stapling as in the Xerox Corporation "9900" copier is shown for example in Xerox Corporation U.S. Pat. No. 4,589,804 to Braun et al.; U.S. Pat. No. 4,361,393 to Noto and U.S. Pat. No. 5,024,430 issued Jun. 18, 1991 to Nobuyoshi Seki et al. (Ricoh), which also returns stapled sets to the bin, and has a stapler movable along the array of bins. Recent Japanese owned patents in this area include U.S. Pat. No. 4,762,312 issued Aug. 9, 1988 to Y. Ushirogatn (Ricoh); Minolta U.S. Pat. No. 4,801,133 issued Jan. 31, 1989; and several Canon patents and EPO patent application publications on in-bin stapling systems such as EP 301-594, 5, and 6-A. Also, U.S. Pat. No. 5,125,634 issued Jun. 30, 1992 to Frederick J. Lawrence (Gradco); U.S. Pat. No. 5,131,642 issued Jul. 21, 1992 to Hiroshi Yamamoto (Ikegami Tsushinki) and U.S. Pat. No. 5,150,889 issued Sep. 29, 1992 to Taguchi (Mita).

As may be seen from the above and other references, integral sorter/stapler units with in-bin stapling are well known. However, typically, as disclosed, heretofore the stapler unit must move or pivot partially into and out of each bin for each stapling of each compiled copy set therein, or the compiled set must be moved out of the bin, stapled and moved back into the bin, or the bin must laterally move or pivot into the stapler unit.

By way of background, in-bin stapling is typically used in a sorter module at the output of an automatic copying machine which does not have recirculating document set capability, wherein reproduction of multipage originals or sets of documents is made by sequentially making the desired number of copies of a first page in the set, collecting these copies in separate individual trays or bins, then sequentially making the desired number of copies of the second and subsequent pages of the set and respectively stacking them on top of the first page copies, etc., repeating this for all of the documents, and thereafter stapling the now collated copy sets in each bin. The staple head can be movable vertically relative to the array of bins, or the bin array can move vertically past a stapler maintained at a constant vertical level. In plural bin sorter systems, circulation for copying of the document set more than once is not required, providing the number of empty bins available exceeds the number of collated copy sets being made at that time.

If precollated copy sets output is provided, by an RDH or an electronic printer (well known per se), then a single compiler tray may be used to stack and align sheets for stapling or otherwise finishing each collated copy set, one at a time. The registered and stapled set may then be ejected by opening a registration end gate. Single tray or partial tray copy set compiler/staplers are disclosed, for example, in U.S. Pat. No. 5,098,074, issued Mar. 24, 1992 by Barry P. Mandel, et al; U.S. Pat. No. 4,417,801; 4,541,626; 5,120,047; and 5,201,517. Other compiler/staplers are shown in commonly assigned Xerox Corporation allowed U.S. Apps. Nos. 07/888,091 filed May 26, 1992 by Barry P. Mandel, et al. and 08/057,941 filed May 7, 1993 by Richard S. Smith.

Another potential application of the present system is in a "mailbox" system. That is, an output sheet sorting system capable of independently handling and separating different jobs for different users or addressees automatically and simply. Job sorting or "mailboxing" is thus provided for a printer, copier or facsimile output (encompassed by the term "printer"herein), in which sets or jobs of plural physical sheets outputted by a printer are directed into a particular "mailbox" bin, or set of bins. This allows plural users of a printer to have a shared system which automatically puts different users outputs into different "mailboxes" or sorter bins. "Mailboxing" systems and prior art thereon are further described for example in commonly assigned allowed U.S. application No. 08/067,494 filed May 25, 1993, and B. Mandel U.S. Pat. No. 5,098,638 issued Feb. 1992.

The following additional partial broad definitions may be helpful: "Mailbox[ing]": temporarily (or semi-permanently) assigning a unique predetermined electronic address to designated ones of plural bins of a sorter-like output device and enabling a user's output to be directed into a selected bin so assigned. It may or may not include locked bins. Preferably, the user's mailbox output is in pre-collated jobs with all sheets going to a single bin, not requiring further sorting. "Sorting": conventionally, this refers to sending one copy sheet of each original page into one bin of a sorter, the next copy sheet into the next bin, etc., repeated for the number of copies, until each of the plural bins required has one copy, then stacking one copy sheet of the next original in each said bin, etc, to compile one collated set in each bin. Thus, job or addressee "mailboxing" is not "sorting" in the common or usual sense of collating plural identical copy sheets by sequentially placing each sheet in a different bin, and repeating those steps. However, similar "sorter" hardware may be employed in part if it can provide rapid random bin access and other desired features. "Stacking": providing the ability to arrange sets of sheets into a well controlled, generally vertical, common stack, although partial "offsetting" of separate job sets may be desirable. The terms "sorting" or collating and "mailboxing" as used herein refer to handling or sorting physical, i.e., "hard copy" printed sheets. They do not refer to electronic documents or images, which are much easier to manipulate. The term "stapler" herein encompasses stitchers and other stack binders. These and other plural sheet fastening systems in general may be referred to as "fasteners" or "finishers". "Registered" here refers to squaring or maintaining square (aligned) at least one edge of the sheets in a stack.

Further by way of background, as is well known in the art, for better stacking registration, it is often desirable to sequentially deposit the outputted sheets for stacking onto an inclined surface. Initially this is the inclined sheet stacking surface of the empty stacking tray, and then it is the correspondingly inclined upper surface of the sheets previously stacked thereon. If the stacking tray surface is upwardly inclined relative to the sheet input into the tray, this is known in the art as "uphill" stacking. It is called "downhill" stacking if the stacking tray slopes downwardly away from the sheet input. There are many advantages to using "uphill" or "downhill" stacking, either for stacking per se, or for stacking in a compiler for registered stack stapling or other binding or finishing. It allows different sizes of sheets to be stacked using the same paper path and the same tray system, using simple gravity assisted stacking against a simple inboard or outboard registration wall or surface, and therefore, is relatively less expensive than more complicated active stacking registration/alignment systems, such as those requiring scuffers, flappers, tampers, joggers, etc., although the latter can be additionally provided for stacking and registration assistance. The present system can be utilized with either "uphill", "downhill", or horizontal stacking trays.

Although a "downhill" stacking system is illustrated in the examples herein, for convenience of illustration, with sheet edge registration at the outside or downstream end of the stacking system, the present system may also be used with a copier or printer output system with an "uphill" or horizontal set registering compiler/-finisher, or the like. As noted above, ejecting sheets or sets of sheets into a downhill stacker utilizes an outside instead of an inside registration end wall. As shown in above-cited and other compiler art, a floppy belt or other feeder may be provided for feeding sheets against the registration wall if gravity is not fully effective to do so.

"Uphill" stacking lends itself to stacking registration at an inboard end or side of a reproduction machine and/or a connecting modular stacking unit. That is, at the sheet input side of the stacking tray. It thereby reduces cantilever forces on cantilevered stacking trays. It also automatically slows down the ejected sheets, due to their initial "uphill" movement. The sheets then reverse their movement to slide back down against an upstanding wall or edge adjacent to but underlying the sheet ejection slot or nip. Incoming sheets thus cannot stub on the end of the stack in the tray, if the further sheets enter above the top sheet of the stack (which normally rises with the stack level).

However, it may also be seen from the cited art that with "downhill" stacking into a downwardly inclined stacking tray, the downstream upstanding registration edge can be removed or opened, so that the copy set can slide out of the tray after the sheets have been registered. This may be desirable after the set is stapled, so that stapled sets may be collected elsewhere. (Ejecting unstapled sets can misalign or scatter the sheets in the set.)

Further by way of background on sheet stacking difficulties in general, outputted sheets are usually ejected into the stacking tray from above one end thereof. Normal output stacking is by ejecting sheets from above one end of the top sheet of the stack of sheets onto which that additional ejected sheet or sheets must also stack. Typically, each sheet is ejected generally horizontally (or slightly uphill initially) and continues to move horizontally by inertia, and with gravity if stacking is "downhill". That is, stacking sheets are not typically effectively controlled or guided once they are released into the stacking tray area. The sheets fall by gravity into the tray to settle onto the top of the stack. However, sheet settling (falling) is resisted by the relatively high air resistance of the sheet to movement in that direction. Yet, for high speed reproduction machines output, sheet stacking must be done at high speed, so a long sheet settling time is undesirable.

The stacking of sheets is made even more difficult where there are variations in thickness, material, weight and condition (such as curls), in the sheets. Different sizes or types of sheets, such as tabbed or cover sheets or Z-folded or other inserts, may even be intermixed in the copy sets in some cases. The sheet ejection trajectory and stacking should thus accommodate the varying aerodynamic characteristics of such various rapidly moving sheets. A fast moving sheet can act as a variable airfoil to aerodynamically affect the rise or fall of the lead edge of the sheet as it is ejected. This airfoil effect can be strongly affected by curls induced in the sheet, by fusing, color printing, etc.. Thus, typically, a restacking ejection upward trajectory angle and substantial release height is provided, well above the stack height or level at the sheet ejection point. Otherwise, the lead edge of the entering document can catch or snub on the top of the sheet stack already in the restacking tray, and curl over, causing a serious stacking jam condition. However, setting too high a document ejection level to accommodate all these possible restacking problems greatly increases the sheet settling time for all sheets, as previously noted, and creates other potential problems, such as sheet scattering.

Sheet scatter within a stack has at least three negative consequences. First, if the stacker assembly has a sets offsetting feature, intended to provide job set separations or distinctions, scatter within a stack makes such set distinction more difficult. Secondly, a substantial stack within which individual sheets are not well aligned to each other is more difficult for an operator to grasp and remove from the stacker. Thirdly, a misaligned stack is not easily loaded into a box or other transporting container of corresponding dimensions.

The system disclosed herein overcomes various of the above and other problems without sacrificing the desired output and stacking positions for the outputted sheets, or without requiring a complex or costly stapler movement mechanism.

Another feature of the disclosed embodiment is to provide a sheet stacking, registration and set fastening system for stacking, registering and fastening stacked sets of plural printed sheets fed from a reproduction apparatus onto a stacking area of a defined area stacking tray, comprising a vertically extending laterally movable sheet stacking edge registration system adjacent at least one edge of said stacking tray for edge registering sheets stacked in said stacking tray in an edge registration area; a set fastening system laterally movable parallel to said edge registration area of said stacking tray to fasten a stack of sheets edge registered in said stacking tray in plural different fastening positions; said sheet stacking edge registration system having plural movable components providing access therethrough to said stacking tray by said set fastening system; said set fastening system continuously extending into said stacking area of said stacking tray through said edge registration system for said plural different fastening positions; said sheet stacking edge registration system being automatically movable in coordination with said movement of said set fastening system to not obstruct said set fastening system for said plural different fastening positions yet maintain registration of a stack of sheets in said stacking tray stacking area at said edge registration area thereof with at least a portion of said plural components of said registration system.

Other disclosed features, individually or in combination, including those wherein said set fastening system comprises a stapler head with stapling jaws extending into said stacking area which moves in a simple linear path parallel to but inside of said edge registration area; and/or wherein said edge registration system comprises plural independently pivoted fingers successively engaged and moved out of the way by said linear path movement of said stapler head; and/or wherein said edge registration system edge comprises plural arms pivotally mounted in the movement path of said set fastening system and pivotal relative to said stacking tray; said pivotal arms normally extending substantially vertically above said stacking tray; said pivotal arms being adapted to sequentially be at least partially pivoted down by said movable set fastening system in the position at which said set fastening system is extending into said stacking tray; and said pivotal arms automatically pivoting upwardly to redefine said sheet stacking registration edge when not so folded down by said set fastening system; and/or wherein said edge registration system comprises expandable and contractible accordian folded registration wall forming members; and/or wherein said edge registration system comprises one side of a flexible wall backstop member extending on opposite sides of said set fastening system, which flexible backstop member is movable with said set fastening system; and/or wherein both said edge registration system and said movable set fastening system are outside of said stacking tray and said defined stacking area and said edge registration area extends slightly beyond one edge of said stacking tray so that said stacking tray cannot interfere with movement of said set fastening system; and/or wherein said edge registration system comprises an expandable and contractable wall backstop member extending on opposite sides of said set fastening system, which backstop member is movable with said set fastening system; and/or wherein parts of said edge registration system are attached to opposite sides of said set fastening system.

As to specific hardware components which may be used with the subject apparatus, or alternatives, it will be appreciated that, as is normally the case, various suitable specific hardware components are known per se in other apparatus or applications, including the cited references and commercial applications thereof.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the examples below, as well as the claims. Thus, the present invention will be better understood from this description of embodiments thereof, including the drawing figures (approximately to scale) wherein:

Figure 1:
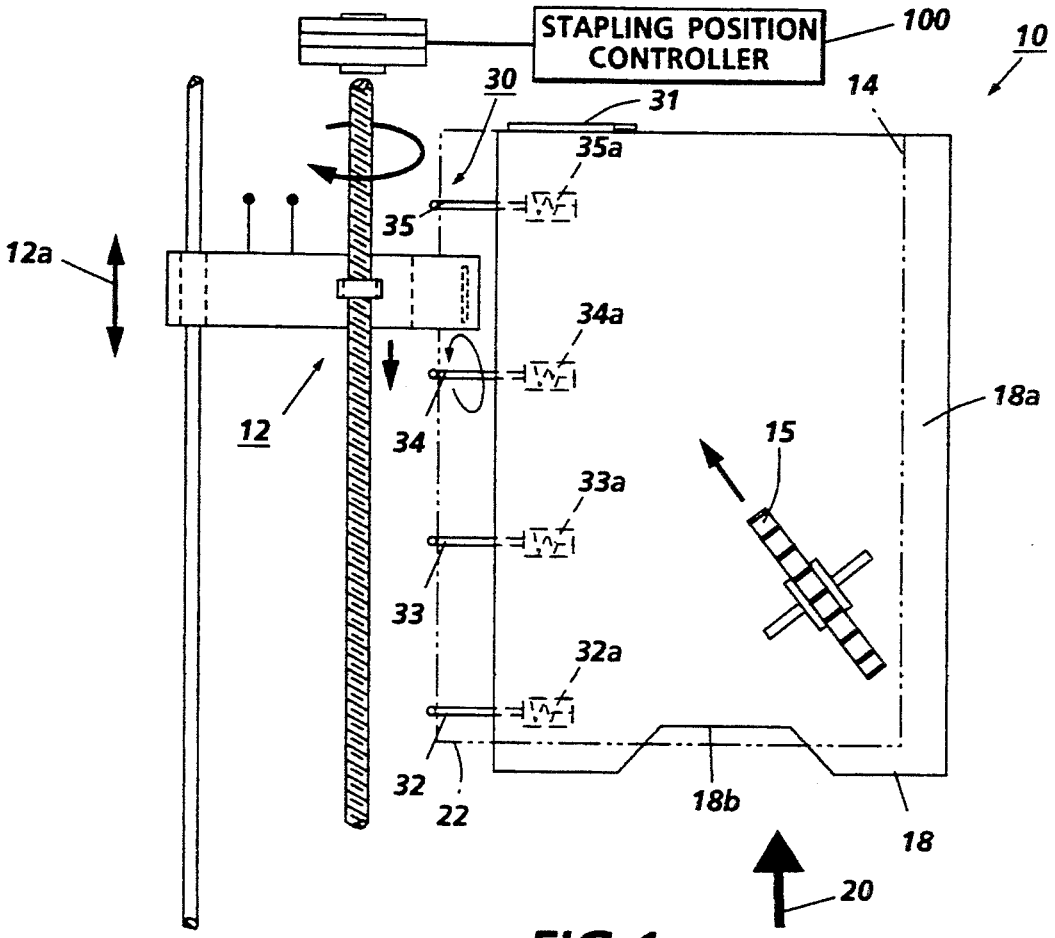
FIG. 1 is a partially schematic top view of one exemplary such copy sheet output registered stacking and finishing system with one type of exemplary repositionable registration end wall elements.
Figure 2:
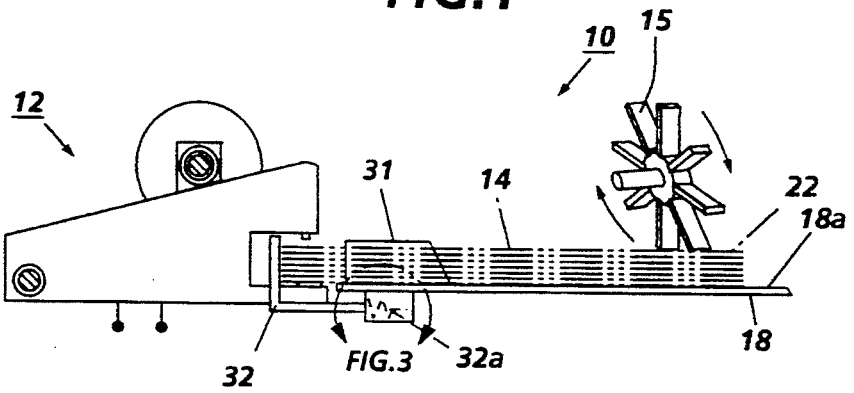
FIG. 2 is a side view of the embodiment of FIG. 1.

The present invention is not limited to the specific embodiments illustrated herein. The specific exemplary embodiments disclosed here show (for drawing clarity) generally horizontal compiler trays. However, they could also be "downhill" or "uphill" stacking trays with an inclined stacking surface at a desired stacking angle to the horizontal. Desirably, such stacking tray or trays may be "uphill" stacking trays, and/or may be only one tray of a multi-bin sorter or plural user printer job separator "mailbox" unit. The stacking tray in "uphill" or "downhill" examples would preferably have its sheet stacking registration wall at the lowermost end of the stacking surface (upstanding approximately perpendicular to that inclined stacking surface rather than exactly vertical) so that the sheets would move by gravity down against that registration wall to stack and be edge registered. A "floppy belt" type reverse feeding top sheet jogger may desirably be used for uphill stacking with registration at the downhill end, as shown in U.S. Pat. No. 4,883,265; 5,098,074; 5,137,265; 5,288,062; and the above-cited D/92331, although another conventional flapper/jogger 15 is illustrated herein. As is also shown in those and other patents, automatic uphill (downstream) set ejection in uphill compiling on other stacking systems may also be provided.

Referring first to FIGS. 1–4, there is shown one example 10 of the subject sheet stacking, registration and finishing system. A different exemplary such system 11 is shown in the example in FIGS. 5–7. A variant thereof is the system 13 of FIGS. 8–13. However, the same tray and same simple stapler (or other fastener) system 12 with a linear path 12*a* may be used in all three embodiments 10, 11 and 13. A simple controlled 100 motor driven lead screw and slide rail system is shown here for stapler 12 movement and positioning, but cable or other drives may be used. All these exemplary stacking systems 10, 11 or 13 may utilize an otherwise conventional fixed copy sheet output tray such as the illustrated stacking tray 18. (I.e., for convenience of description and illustration the same tray 18 is shown in all three examples here.) The systems 10, 11, 13, or others, may be used in various stackers, sorters, compiler/finisher units, or other output modules, or integral a copier or printer itself. The systems 10, 11, 13 or the like, may be part of a self-contained, stand-alone or independent high capacity stacking unit, wheeled up to and docked with any reproduction apparatus, when desired, for receiving its outputted printed sheets 14, directly or via a two level interface transport.

In the systems 10, 11, and 13 illustrated here the stacking tray 18 has a sheet input path 20 directly or indirectly from a printer or other reproduction apparatus providing output sheets 14. The input path 20 may be provided by roller nip or belt sheet feeders or other sheet ejectors. The upstream end of the tray 18 is here closely adjacent the sheet input 20, for being fed sheets, or sets of sheets, for stacking. This stacking systems 10, 11, or 13 can stack a large number of sheets 14 into tray 18 in a neat, registered, stack 22 on its stacking surface 18*a*. Note that if the system is of the above-cited uphill type the sheet input path will be in over the top of the stapler and then the sheet is reversed and fed back by the floppy belt jogger/feeder into the open jaws of the stapler and against the registration wall or fingers.

However, as shown here, preferably the edge of the stack to be registered and stapled extends slightly beyond that edge of the tray 18 on the stapling side of the tray. I.e., the sheet stacking area does not exactly coincide with the tray area. Cutouts or notches 18*b* may be provided in at least one edge of the tray 18 for ease of set removal access. Other notches could be provided on the stapler side of the tray, if desired, for stapling, but are not required in these embodiments 10, 11 or 13 since here the stapling and registration positions are beyond that edge of the tray, so the tray cannot interfere with stapling, and the stapling positions are not restricted to tray notch positions.

If desired, to increase stacking height capacity or control, various suitable elevator mechanisms known in the art for vertically moving stacking trays may be used here. Examples include EK U.S. Pat. No. 5,026,034, FIG. 2, Xerox Corporation U.S. Pat. No. 4,925,171; Canon Corp. 5,137,265; Norfin, Inc. 3,414,254, and other art cited above. It may utilize a cable, ratchet, lead screw, parallelogram linkage, or other suitable elevator movement mechanism. A detailed vertical elevator drive system is also shown and described in U.S. Pat. No. 5,098,074 by Barry Mandel, in Columns 5–6, inter alia. As taught in various of the cited references, it is known to operate such an elevator system by incrementally controlling it via a conventional microprocessor controller with stack height input from a conventional stack height sensor, as in said Xerox Corporation U.S. Pat. No. 5,098,074, or 5,033,731 (D/89464).

Figure 5:
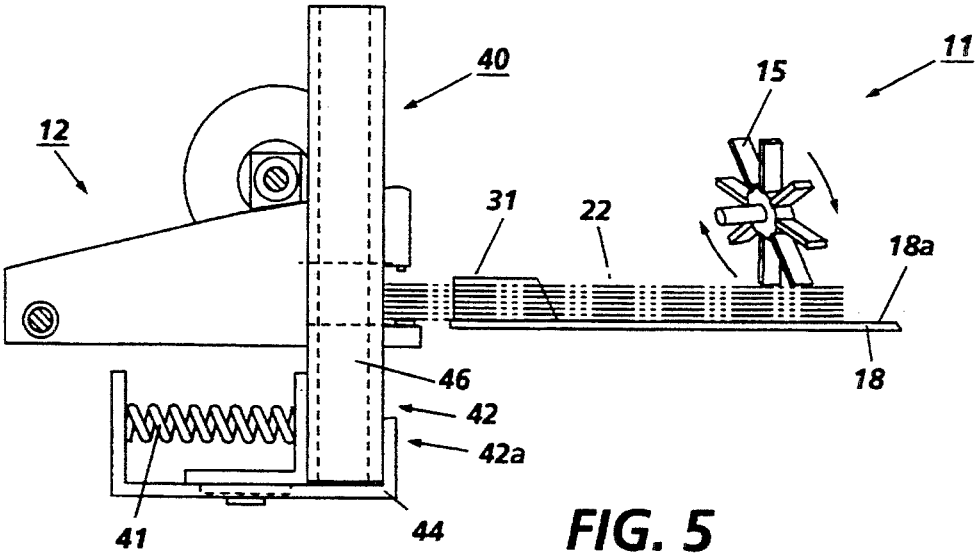
FIG. 5 is a side view of another embodiment or example of the subject stacking and finishing system, with a different variable position registration wall elements system, but similar simple linear movement stapling head repositioning provided for plural stapling of the copy set in the bin.
Figure 6:
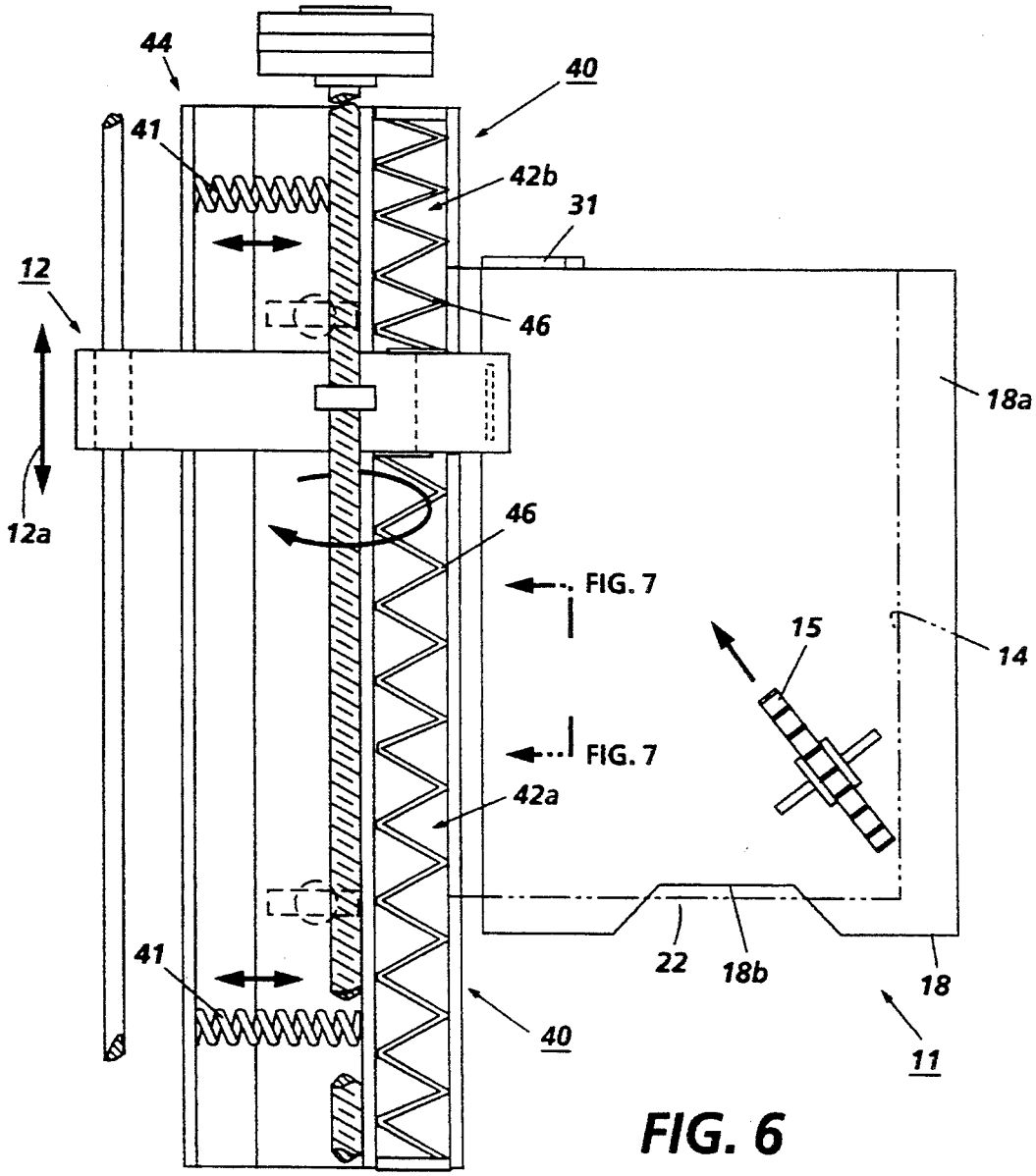
FIG. 6 is a top view of the embodiment of FIG. 5.
Figure 7:
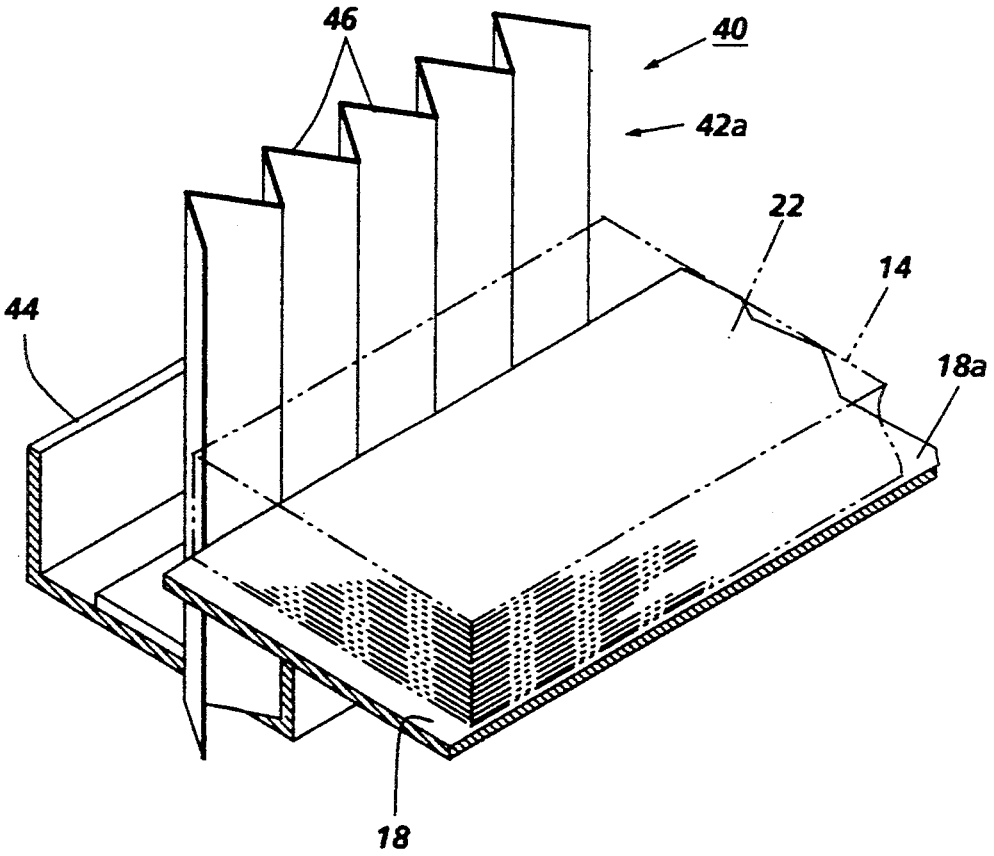
FIG. 7 is a partial perspective view of the embodiment of FIGS. 5 and 6.
Figure 8:
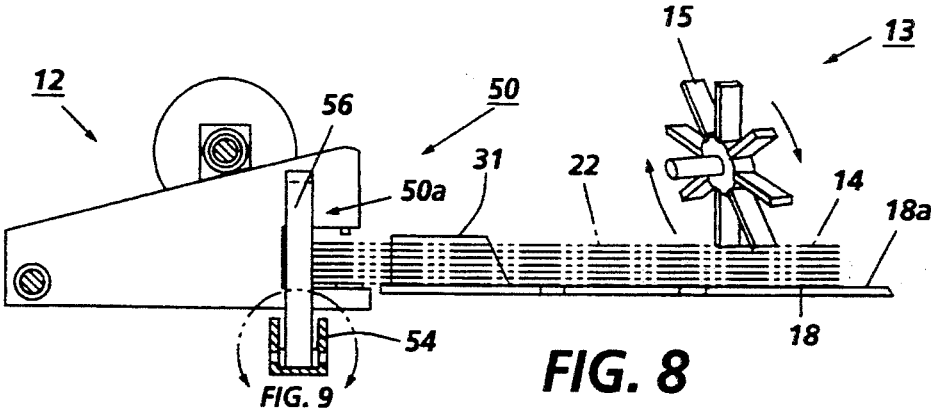
FIGS. 8–13 are different views of a third embodiment thereof.
Figure 9:
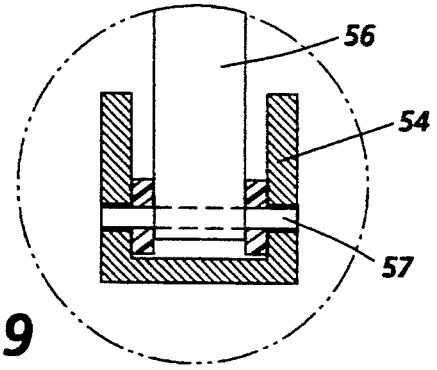
Figure 10:
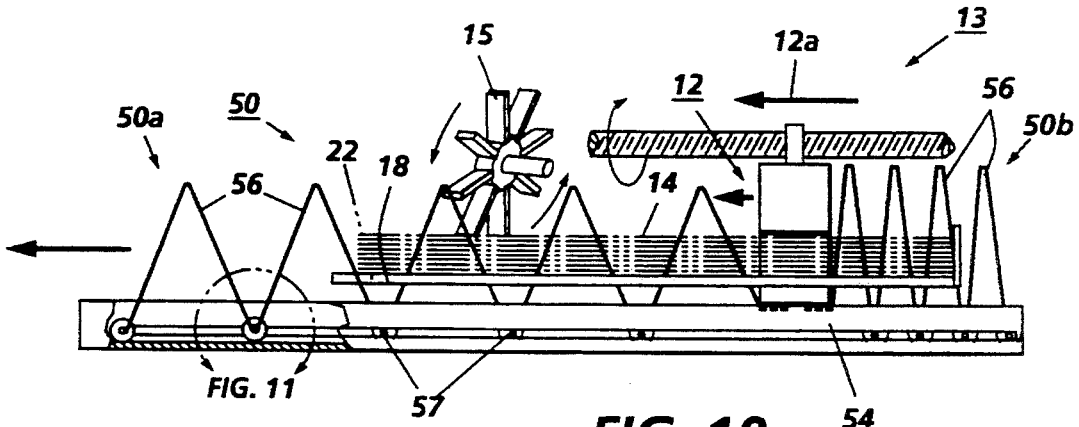
Figure 11:
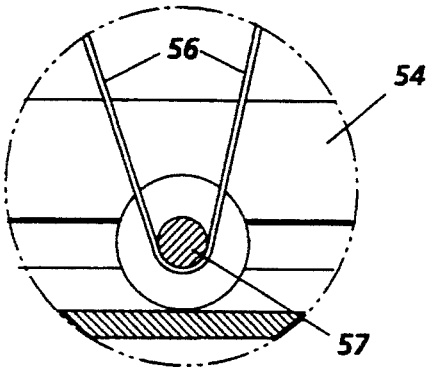
Figure 12:
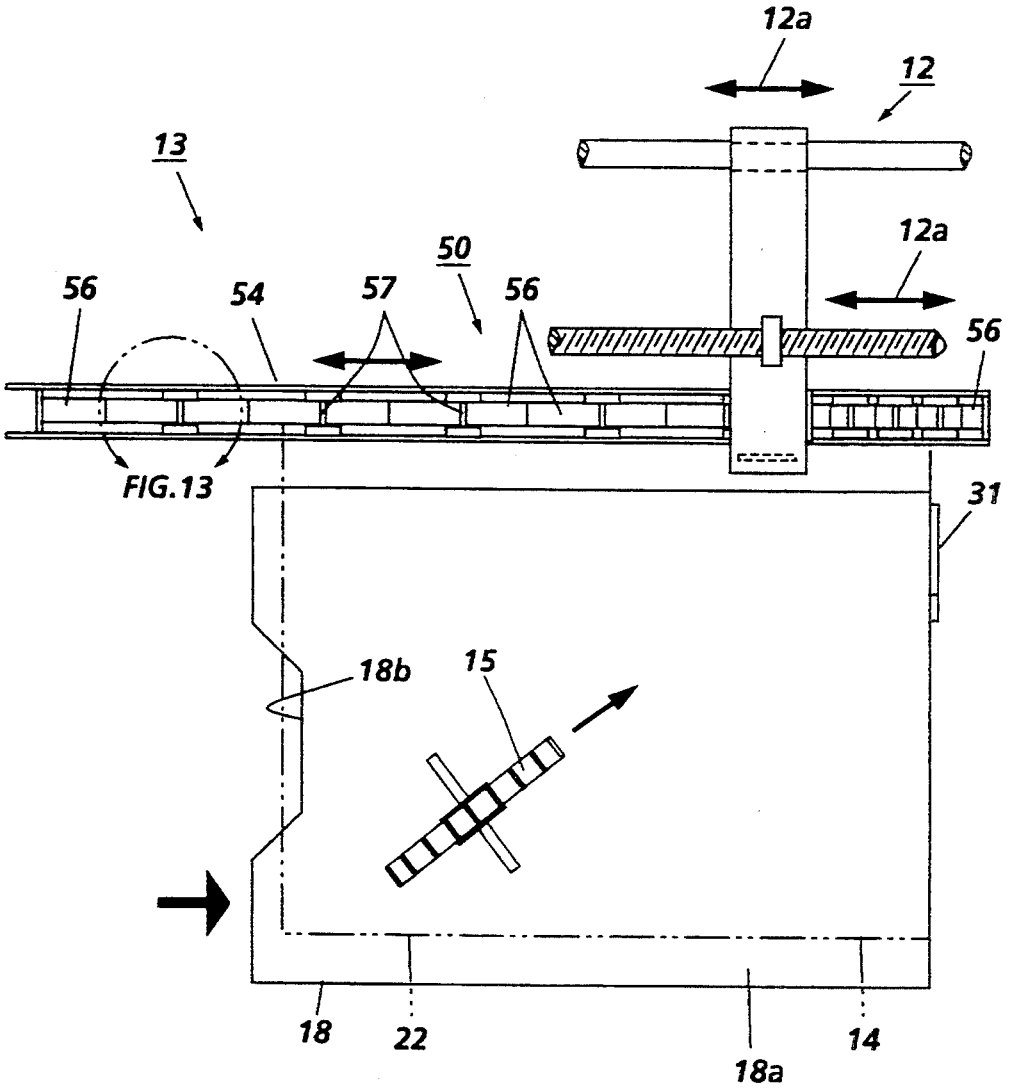
Figure 13:
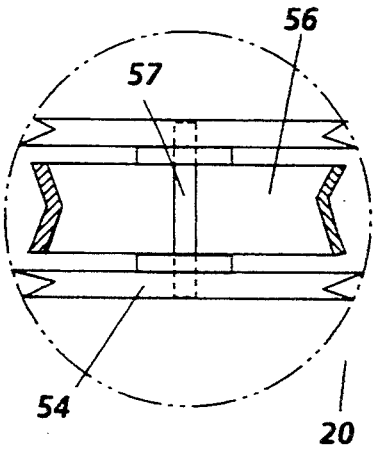

As noted, the exemplary embodiments 10, 11 and 13 here desirably have stacking trays 18 providing an inclined stacking surface 18*a* at a desired stacking angle from the horizontal sufficient to slide stacking sheets down against the upstanding sheet stacking registration edge surface or registration end wall system at the lower end of the stacking surface 18*a*, preferably assisted by a jogger 15 or other jogger described above. A registration end wall system 30 example is shown in FIGS. 1–4, a registration system 40 example is shown in FIGS. 5–7 and another registration system 50 is shown in FIGS. 9–12. These registration systems 30, 40 or 50 here all can register each incoming (top) sheet, maintain edge alignment or squaring of the entire stack end, and keep any part of the stack 22 from sliding further off the tray 18, even as the stack 22 substantially increases in height.

This stacking edge alignment systems 30, 40 or 50 are not fixed here, as in a conventional tray stacking system. They automatically move out of the way of to accommodate unobstructed lateral movement of the stapler system 12 relative to the stack 22. However, substantial portions of the edge alignment system stay in registration positions extending above the top of the stack 22, to maintain a stack registration relationship with the sheet stack 22. That is, the stack registration and edge alignment system 30, 40 or 50 herein maintain set stacking alignment in a stacking tray by providing a laterally variable or laterally movable "backstop", "wall", or bin rear registration edge, for providing "in bin" stapling in plural positions without losing such stack registration.

In the first system example 30 of FIGS. 1–4, elongated otherwise rigid backstop registration arms such as 32, 33, 34, 35 (three or more) are pivotally mounted to tray 18 (or a connecting or adjacent mounting frame thereunder, as shown) at the stapling edge end of the tray. These pivotal arms 32–35 are each independently spring loaded (by springs 32*a*–35*a*) to normally be pivoted up transversely of the tray 18 surface 18*a* to a height above the stack 22 top or maximum stacking level. That is, these pivotal stack end retainers 32, 33, 34, 35 desirably normally automatically stay up with a stack 22 thereagainst. (However, as an additional optional feature, the arms may all be automatically pivoted down for stack unloading from tray 18 after stapling if stapled set unloading is from that end of the tray rather than (preferably) from the opposite end.) The arms 32, 33, 34, 35 may be longer than those illustrated, and may even overlap or cross each other when held down, to increase the maximum stacking capacity. These arms 32, 33, 34, 35, or the like, and their mountings, provide sufficient rigidity in the registration plane to provide a consistent downhill end registration wall or edge, even for heavy or high stacks 22.

The arms 32, 33, 34, 35 are individually independently movable down by the stapler head 12, or some extension thereof, as the stapler head 12 moves along its path 12*a* to a desired stack 22 stapling position, so as not to interfere with that stapler lateral movement. This also allows the continuing constant extension of the stapling head 12 into the tray 18 set stacking area upstream of the registration arm 32, 33, 34, 35, to enable stapling the stack 22 inside, not outside, the tray 18 stacking (registration) area. The respective pivotal movements of arms 32, 33, 34, 35 downwardly (into the stapling position) can be somewhat like windshield wipers. Note the rotation movement arrows on 34 in FIG. 1 and FIG. 4, showing which way it will be moved by the stapler 12 movement 12*b*.

After the stapling head 12 passes a particular arm 32–35 area or location, the individual spring of that arm automatically extends back up that respective arm. Thus, there are always some arms 32–35 (two or more) in the up or registration position to continue to retain the stack 22 registered in the tray 18.

Turning now to the second, alternative, embodiment system 11 of FIGS. 5–7, with a different registration wall system 40, it may also provide set stacking into the same (or another) tray or bin 18, and similar registration with unobstructed stapler 12 movement. The system 40 differs in providing a flexible or accordian wall backstop 42 for the stack end registration surface, with accordian wall elements 46, which accordian wall 42 moves laterally with the moving stapler unit 12. This flexible backstop 42 here is at least partially supported or backed up with a rigid frame member 44, in which it is slidably mounted, and preferably held forward by springs 41 shown in FIGS. 5 and 6. A left portion 42*a* is compressed on the left side of stapler unit 12 as the stapler moves on path 12*a* towards it, and expands as the stapler moves away. Likewise, a right side portion 42 compresses and expands with stapler head 12 movement. (The operation of the somewhat similar third embodiment system 13 of FIGS. 8–13 is further described below.)

Note that in all three disclosed systems here only a single set fastening, e.g. stapler, system is needed, saving costs and maintenance, yet staples can be placed along the edge of the set stack 22 in any number and in any desired locations along the copy set edge margin with a simple back and forth linear stapler head motion. The stapling jaws can always remain inside the stack end registration plane. The linear movement 12*a* of the stapler head 12 can be along various linear rods, rails, helical screw shafts, etc., with cable or screw drives, or other well known simple mechanisms, not requiring complex pivoting or insertion mechanisms.

In any of the system embodiments herein, after the selected stapling has been completed, the edge registration gate system and the stapler head can be moved further laterally, out of the way, to provide for ejection of the stapled set from that end of the compiler or sorter bin onto a set transport and/or set stacker. (See, e.g., the above-cited U.S. Pat. No. 5,098,074; 5,217,215; D/88383, etc., and art cited therein.) Or, as noted, the set can be ejected from another side of the tray.

In the systems 11 and 13 here, unlike system 10, the registation walls 40 and 50 are shown extending well above the open sheet receiving jaws of the stapler 12. This allows sheets to be fed into the tray 18 well above the stapler from any direction, even if "airplaning" well above the stack, yet be stopped and registered by these higher walls 40 or 50. In that case the stapler 12 is preferably then laterally moved and parked off beyond one side of the tray stacking area during set stacking, and not moved in for stapling until the entire set of sheets to be stapled is accumulated, jogged unto registration (by a different jogger) and has all settled down below the stapler jaws opening level. Then the stapler moves in to staple along the set edge. In contrast, in system 10 of FIGS. 1–4, the registration wall provided fingers 32–35 only needs to be as high as the stapler 12 jaws opening (which defines the maximum stapled set height).

It is noted that when either a compiler/stapler station or in-bin stapling is utilized, a side tamper may also be provided to job or tamp each incoming set sideways, for two-axis or corner compiling, especially for corner stapling with the stapler unit. Also, the stapled set may be laterally offset before ejection of the stapled set from the stacker tray. Various known lateral or side edge registration systems may be provided compatibly with the present systems. Some examples are in art cited herein, and in U.S. Pat. No. 5,044,625 (D/87242) and art cited therein. Accordingly, there is no need to illustrate several examples here. The flapper/jogger 15 here is illustrated angled orthogonally towards side wall 31 as well as the end registration plane and is one example of such a corner registration system.

The present system may also be optionally combined with an orbiting nip or other optional sheet output inverter and/or plural mode output, etc., as disclosed by Denis Stemmle in U.S. Pat. No. 5,201,517 issued Apr. 13, 1993 (D/89465), entitled "Orbiting Nip Compiler for Faceup or Facedown Stacking".

In all of the illustrated registration system embodiments herein, at least two or more spaced apart portions of the edge registration system stay in the edge registration plane and thus maintain stack edge registration at all times, irrespective of the position of the stapler head 12. In the FIG. 1 embodiment 30, it is all those upstanding tabs or arms 32–35 which are not pivoted down by the stapler head 12 at its then current position. The other arms are held up by their springs. In the FIGS. 5–7 embodiment 40 it is the front or inside edges of the accordian wall 42 wall segments 46, which are maintained in the registration plane on each side of the stapler head by retention bar 44 and may be spring-loaded against that retention bar 44 by a spring 41 loaded pressure bar engaging the rear edges of wall 42, as shown. Wall 42 segments 42*a* and 42*b* may be provided by two plastic multiple folded leaf springs. In the third, FIGS. 8–13 embodiment 50, it is the front or inside edges of the accordian folded arm elements 56, held in the registration plane here by at least one set of lower 54 guide rails 54. These guide rails 54, shown here with slide pins 57, allow movement of elements 56 vertically as the elements 56 expand on one side and contract on the other side of the stapler head 12, as the stapler moves along path 12*a*. This system 50 may also employ two multiple folded leaf spring members (albeit folded in the opposite direction from those of FIGS. 5–7) as the left wall portion 52*a* and right wall portion 50*b*. Alternatively, a pantograph or crossed arms, center pinned, wall could be used.

Figure 3:
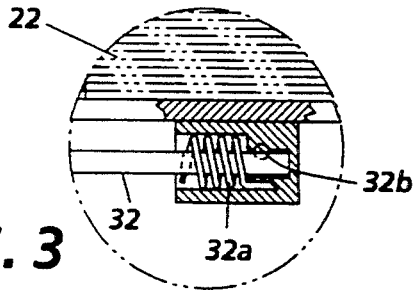
FIG. 3 is an enlarged portion of FIG. 2.
Figure 4:
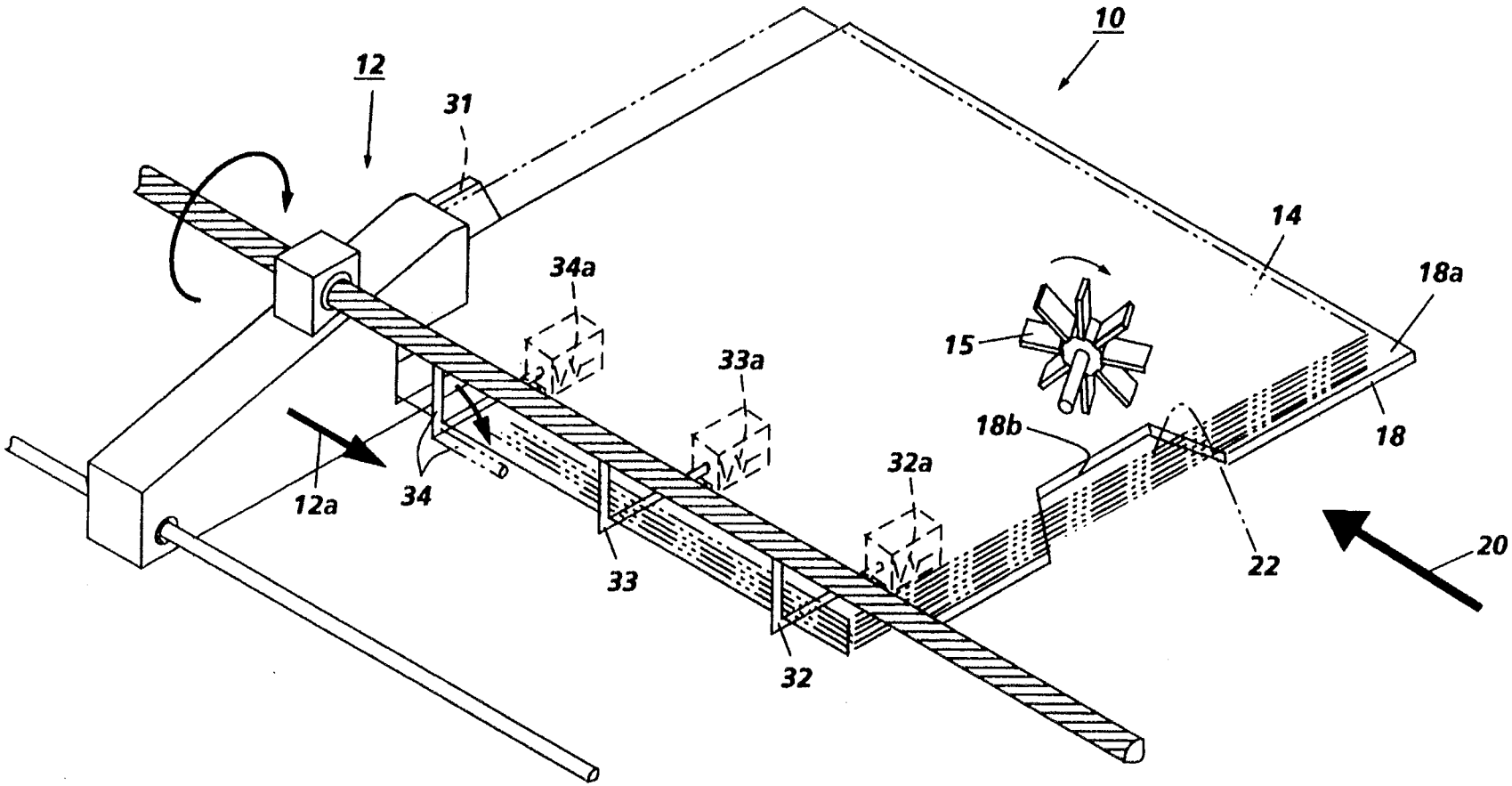
FIG. 4 is a perspective view of the embodiment of FIGS. 1–3.

In the embodiment 10 of FIGS. 1–4, additional features can include a simple cam 32*b* and cam surface, best seen in FIG. 3, for the mounting portion of the arms 32–35, so that when the arms are pivoted down by the stapler 12 they also move back slightly away from the registration plane, so as not to contact and disturb the stack 22 edge being stapled.

While the embodiments disclosed herein are preferred, it will be appreciated from this teaching that various other alternatives, modifications, variations or improvements therein may be made by those skilled in the art, which are intended to be encompassed by the following claims:

What is claimed is:

1. A sheet stacking, registration and set fastening system for stacking, registering and fastening stacked sets of plural printed sheets fed from a reproduction apparatus onto a stacking area of a defined area stacking tray, comprising:

a vertically extending laterally movable sheet stacking edge registration system adjacent at least one edge of said stacking tray for edge registering sheets stacked in said stacking tray in an edge registration area;

a set fastening system laterally movable parallel to said edge registration area of said stacking tray to fasten a stack of sheets edge registered in said stacking tray in plural different fastening positions;

said sheet stacking edge registration system having plural movable components providing access therethrough to said stacking tray by said set fastening system;

said set fastening system continuously extending into said stacking area of said stacking tray through said edge registration system for said plural different fastening positions;

said sheet stacking edge registration system being automatically movable in coordination with said movement of said set fastening system to not obstruct said set fastening system for said plural different fastening positions yet maintain registration of a stack of sheets in said stacking tray stacking area at said edge registration area thereof with at least a portion of said plural components of said registration system;

wherein said edge registration system comprises an expandable and contractable multielement wall backstop member extending on opposite sides of said set fastening system, which backstop member is movable with said set fastening system.

2. The sheet stacking, registration and set fastening system of claim 1, wherein said edge registration system comprises expandable and contractible accordian folded registration wall forming members.

3. The sheet stacking, registration, and set fastening system of claim 1, wherein said edge registration system comprises one side of a flexible wall backstop member extending on opposite sides of said set fastening system, which flexible backstop member is movable with said set fastening system.

4. The sheet stacking, registration and set fastening system of claim 1, wherein said set fastening system comprises a stapler head with stapling jaws extending into said stacking area which moves in a simple linear path parallel to but inside of said edge registration area.

5. The sheet stacking, registration and set fastening system of claim 1, wherein both said edge registration system and said movable set fastening system are outside of said stacking tray and said defined stacking area and said edge registration area extends slightly beyond one edge of said stacking tray so that said stacking tray cannot interfere with movement of said set fastening system.

6. The sheet stacking, registration and set fastening system of claim 1, wherein parts of said edge registration system are attached to opposite sides of said set fastening system.

7. A sheet stacking, registration and set fastening system for stacking, registering and fastening stacked sets of plural printed sheets fed from a reproduction apparatus onto a stacking area of a defined area stacking tray, comprising:

a vertically extending laterally movable sheet stacking edge registration system adjacent at least one edge of said stacking tray for edge registering sheets stacked in said stacking tray in an edge registration area;

a set fastening system laterally movable parallel to said edge registration area of said stacking tray to fasten a stack of sheets edge registered in said stacking tray in plural different fastening positions;

said sheet stacking edge registration system having plural movable components providing access therethrough to said stacking tray by said set fastening system;

said set fastening system continuously extending into said stacking area of said stacking tray through said edge registration system for said plural different fastening positions;

said sheet stacking edge registration system being automatically movable in coordination with said movement of said set fastening system to not obstruct said set fastening system for said plural different fastening positions yet maintain registration of a stack of sheets in said stacking tray stacking area at said edge registration area thereof with at least a portion of said plural components of said registration system;

wherein said edge registration system comprises plural independently pivotal fingers successively engaged and pivoted out of the way by said linear path movement of said stapler head.

8. The sheet stacking, registration and set fastening system of claim 7, wherein:

said plural pivotal arms are pivotally mounted in the movement path of said set fastening system and pivotal relative to said stacking tray;

said pivotal arms normally extend substantially vertically above said stacking tray;

said pivotal arms are mounted to be sequentially be at least partially pivoted down by said movable set fastening system in the position at which said set fastening system is extending into said stacking tray; and said pivotal arms automatically pivoting upwardly to redefine said sheet stacking registration edge when not so pivoted down by said set fastening system.

9. The sheet stacking, registration and set fastening system of claim 7, wherein said set fastening system comprises a stapler head with stapling jaws extending into said stacking area which moves in a simple linear path parallel to but inside of said edge registration area.

10. The sheet stacking, registration and set fastening system of claim 7, wherein both said edge registration system and said movable set fastening system are outside of said stacking tray and said defined stacking area and said edge registration area extends slightly beyond one edge of said stacking tray so that said stacking tray cannot interfere with movement of said set fastening system.

* * * * *